US006000441A

United States Patent [19]

Lee et al.

[11] Patent Number: 6,000,441

[45] Date of Patent: Dec. 14, 1999

[54] MULTI-LAYERED PAPERMAKER'S SEAM PRODUCT WITH FORMED LOOPS

[75] Inventors: Henry J. Lee, Summerville; Billy Summer, Joanna, both of S.C.

[73] Assignee: Asten, Inc., Charleston, S.C.

[21] Appl. No.: 09/133,142

[22] Filed: Aug. 12, 1998

[51] Int. Cl.[6] ..... D03D 13/00

[52] U.S. Cl. ..... 139/383 AA; 442/207; 442/270; 162/904

[58] Field of Search ..... 139/383 AA; 24/33 P, 24/33 C; 264/258; 442/207, 270; 162/904

[56] References Cited

U.S. PATENT DOCUMENTS 3,815,645 6/1974 Codorniu ..... 139/383 A
4,418,726 12/1983 Josef et al. ..... 139/383 AA
4,896,702 1/1990 Crook ..... 139/383 A
4,911,683 3/1990 Legge et al. ..... 474/255
5,531,251 7/1996 Rydin ..... 139/383 AA

*Primary Examiner*—Andy Falik
*Attorney, Agent, or Firm*—Volpe and Koenig, P.C.

[57] ABSTRACT

An endless woven papermaker's fabric of having warp yarns in at least two layers and continuous weft yarns in at least two layers. The warp and weft yarns are interwoven to form a fabric where the first warp yarn layer is adjacent to the second warp layer and the weft yarns define seam loops at two ends of the fabric. Each end of the fabric has at least one warp yarn which is free of interweaving with the weft yarns and is removed to form the seam loops.

6 Claims, 2 Drawing Sheets

MULTI-LAYERED PAPERMAKER'S SEAM PRODUCT WITH FORMED LOOPS

BACKGROUND OF THE INVENTION

1. Field of the Invention

The present invention generally relates to a woven fabric which is designed for use in a paper, cellulose or board manufacturing machine, and which along each end, has a plurality of loops to be included in a seam to form an endless woven fabric. The invention also relates to a method of manufacturing such a fabric.

2. Description of the Prior Art

Seamed papermaking fabrics have seams that allow the fabric to be assembled and disassembled on a papermaking machine without the requirement of stitching or weaving. Prior art seamed fabrics can be divided into two basic categories, the first having seams formed outside of the weaving loom and the second having seams formed in the weaving loom.

The first category of fabrics, those having seams formed outside the weaving loom, includes flat woven fabrics with an independent seam structure attached to the ends of the fabric, such as by sewing a woven tape onto the fabric or piercing it with clipper hooks. These structures have provided poor caliper and density profiles in the seam area. Other structures, such as described in U.S. Pat. No. 4,244,084, are formed with an area free of cross direction yarns near each end of the fabric. Loops are formed by folding each end of the fabric back along itself and then stitching each end to hold the folded ends. This structure again provides poor caliper and density profiles in the seam area due to the fold back thickness, and has a strength and life which is limited to the strength of the stitching holding the folded fabric. These problems have effectively precluded the successful use of any of these types of fabric seams in the wet press section of papermaking machines. Seam loops have also been formed on flat woven fabrics by tying back machine direction yarns at each end of the fabric. However, tying back is generally a time consuming process which must be performed after the fabric is woven.

In the second category, in which a pin seam is formed during the weaving process on the loom, a conventional approach for forming such seam loops is shown in U.S. Pat. No. 3,815,645. In that process, pairs of weft yarns are woven around a forming wire to form the loops and then the forming wire is removed. Seam loops formed by this process are often difficult to mesh together because of their inconsistent sizes, shapes and orientations which result from the weaving method. In addition, when the forming wire is removed, the resultant fabric is generally a flat fabric with loop ends at each end thereof. Along the length of the fabric, the warp yarns weave with both layers of weft yarns, thereby joining the two weft yarns together.

Accordingly, there exists a need for a base fabric having seam loops which provide better fabric properties in the seam area while being easier to make and install.

SUMMARY OF THE INVENTION

The present invention relates to an endless woven papermaker's fabric of a type having warp yarns in at least two layers and continuous weft yarns in at least two layers. The warp and weft yarns are interwoven to form a fabric where the first warp yarn layer is adjacent to the second warp layer and the weft yarns define seam loops at two ends of the fabric. Each end of the fabric has at least one warp yarn which is free of interweaving with the weft yarns and is removed to form the seam loops.

DESCRIPTION OF THE PREFERRED EMBODIMENT

Figure 1:
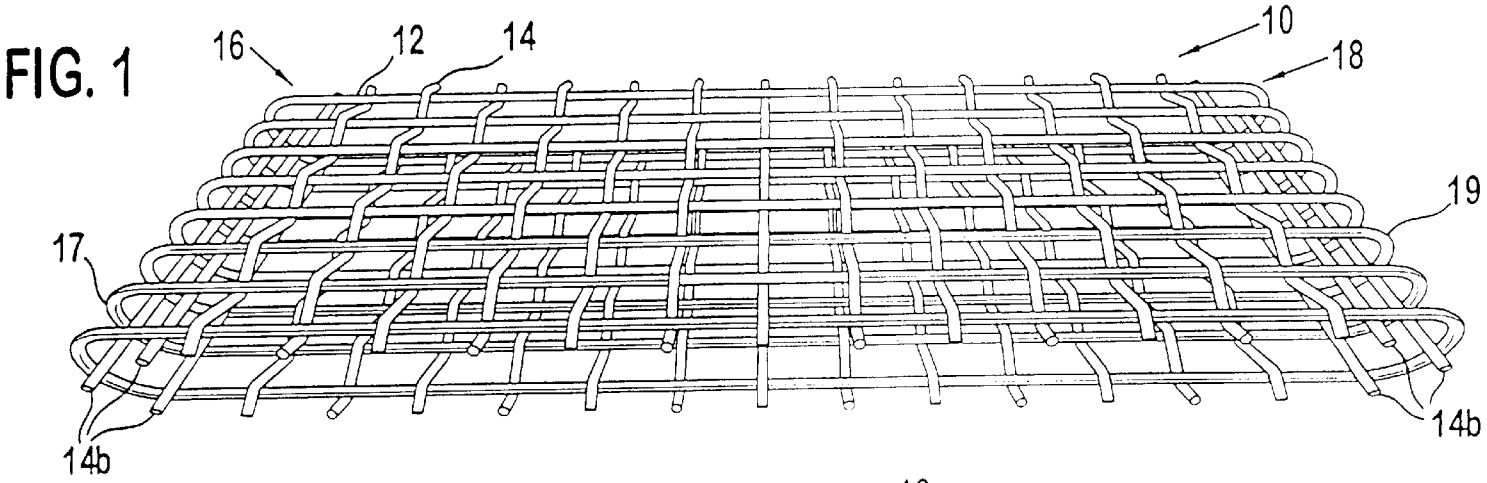
FIG. 1 is a schematic perspective view of the base fabric of the present invention as woven.

The present invention will be described with reference to the drawing figures where like numerals represent like elements throughout.

Figure 2:
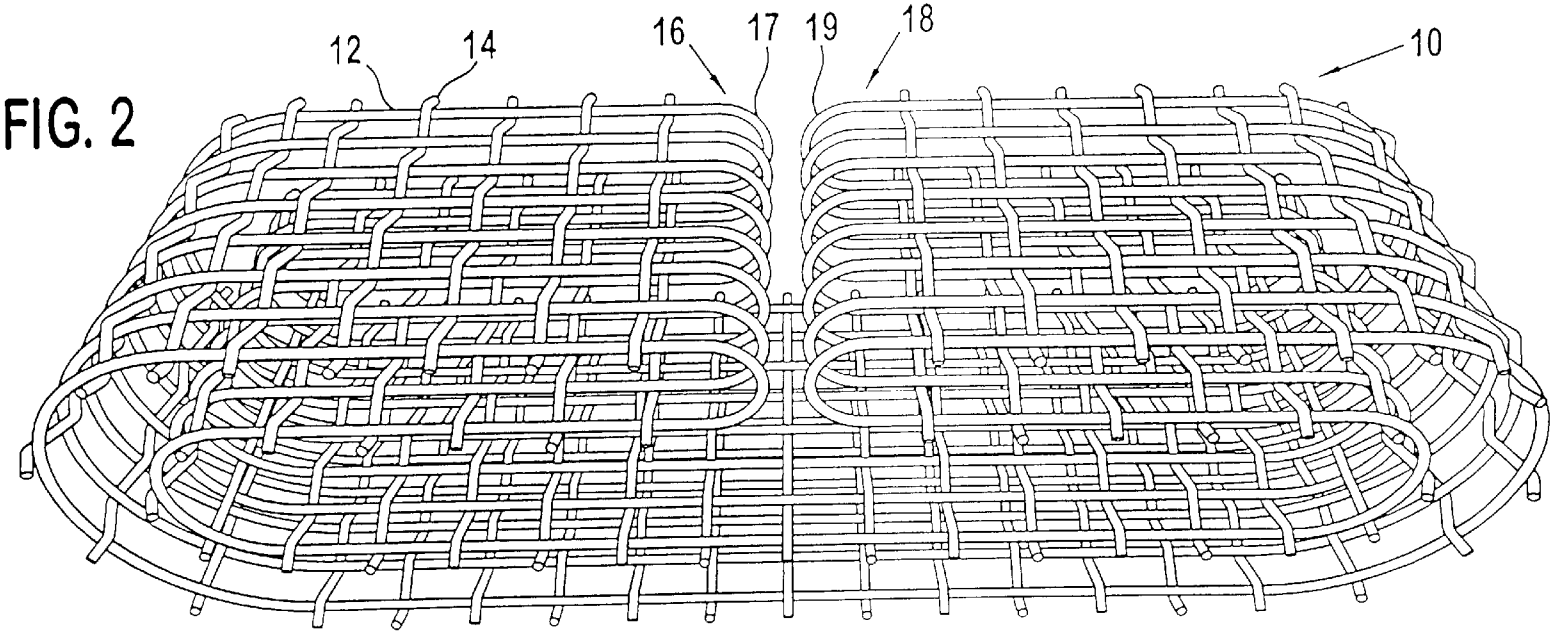
FIG. 2 is a schematic perspective view of the base fabric of the present invention with each end folded over.

Referring to FIGS. 1 and 2, the preferred embodiment of the base fabric 10 of the present invention is shown. The preferred base fabric 10 generally comprises weft yarns 12 that form two layers which are interwoven with two layers of warp yarns 14 as an endless woven fabric. Seam loops 17, 19 are formed at each end of the base fabric 10 by the absence of warp yarns 14*b* from areas at each end of the fabric 10. Each warp free area 16, 18 has an area of substantially uncrimped weft yarns 12 which form the seam loops 17, 19.

Although the warp yarns 14*b* may be interwoven with the weft yarns 12, it is preferred that those warp yarns 14*b* are not interwoven. Instead, the appropriate heddles are maintained in a stationary position during weaving, and therefore, do not move warp yarns 14*b* up and down to interweave with the weft yarns 12. As a result, all of the weft yarns 12 weave about only one side of each warp yarn 14*b*. The warp yarns 14*b* are easily removed from the woven base fabric 10 before any finishing processes to form the warp free areas 16, 18. As a result of the warp free areas 16, 18, the seam loops 17, 19 remain substantially uncrimped after heat setting. The warp free areas 16, 18 are preferably, but do not have to be, formed on the loom edges. In applications in which the warp free areas 16, 18 are not formed on the loom edges, the seam loops 17, 19 can be aligned at the ends of fabric 10 after the fabric 10 is removed from the loom. The length of the seam loops 17, 19 can be varied depending on the requirements of a particular application.

Figure 3:
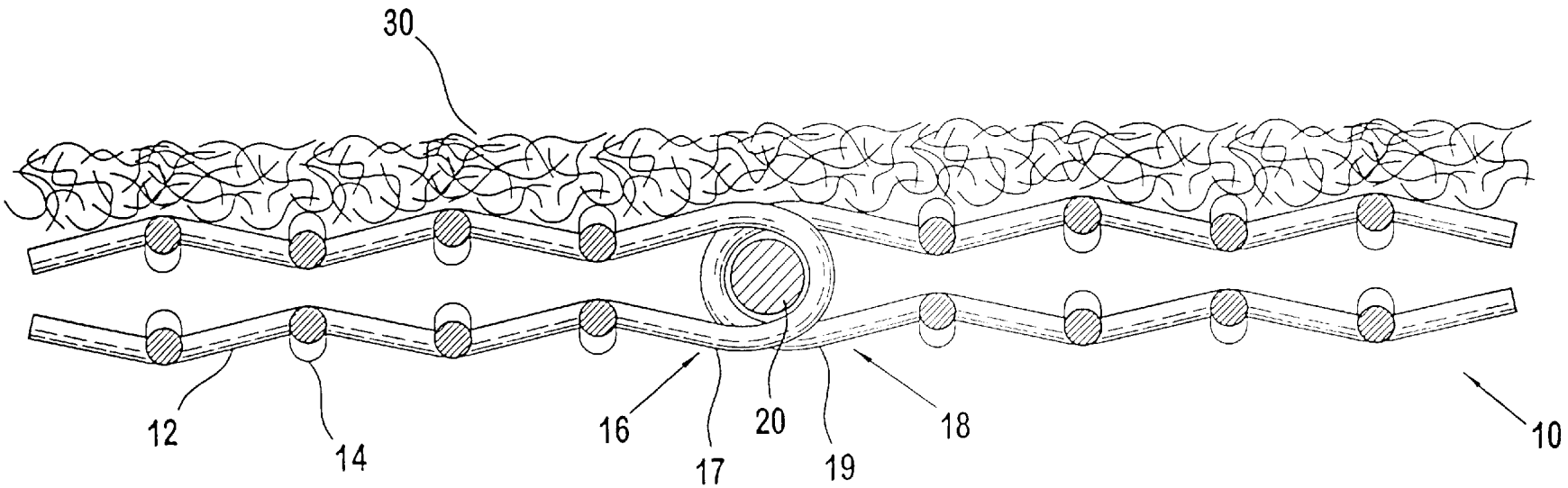
FIG. 3 is a side elevation view of a portion of the fabric of the present invention with the ends joined.

To seam the fabric 10 on a papermaking machine, the ends of the fabric 10 are brought toward each other as shown in FIG. 2. The seam loops 17, 19 are intermeshed and a pintle 20 is inserted therethrough to join the fabric 10, as shown in FIG. 3. Other joining methods known in the art may also be utilized. For example, coil type loops may be inserted between the loop seams 17, 19. A layer of batt material 30 may be applied to one or both sides of the base fabric 10 as desired.

If a particular application requires a more dense fabric, stuffer yarns may be inserted between the layers of the base fabric 10. If a longer machine direction fabric is desired, the base fabric 10 can be produced using known endless fabric weaving methods. In such a fabric, the warp free areas 16, 18 will exist on opposite ends of the fabric once the edges of the fabric are extended in the machine direction.

While the present invention has been described in terms of the preferred embodiments, other variations which are within the scope of the invention as outlined in the claims will be apparent to those skilled in the art.

What is claimed is:

1. An improved endless woven papermaker's fabric of a type having warp yarns in at least two layers and continuous weft yarns in at least two layers, the warp and weft yarns interwoven to form a fabric where the first warp yarn layer is adjacent to the second warp layer and the weft yarns define seam loops at two ends of the fabric, the fabric is characterized by having at least one warp yarn in each fabric end which is free of interweaving with the weft yarns.

2. The fabric of claim 1 wherein the fabric is woven on a loom having opposed edges and the warp yarns which are free of interweaving are adjacent to the edges during weaving.

3. The fabric of claim 1 wherein the fabric is woven on a loom having opposed edges and the warp yarns which are free of interweaving are spaced from the edges during weaving.

4. The fabric of claim 1 wherein batt material is attached to the fabric.

5. The fabric of claim 1 wherein stuffer yarns are positioned between the warp yarn layers.

6. An improved method of forming an open ended papermaker's fabric of a type having a defined number of warp yarns in at least two layers and continuous weft yarns in at least two layers and where the first warp yarn layer is adjacent to the second warp layer and the weft yarns define seam loops at two ends of the fabric which are interdigitated to form a pintle receiving channel, the improvement characterized by the steps of:

interweaving the weft yarns with the defined number minus N warp yarns, wherein N is an integer at least as great as 2, thereby maintaining N warp yarns unwoven but within the fabric; and removing the unwoven warp yarns to form the seam loops.

* * * * *